US006726446B2

(12) United States Patent
Arilla et al.

(10) Patent No.: US 6,726,446 B2
(45) Date of Patent: Apr. 27, 2004

(54) STAY SECTOR OF STATOR SHROUD OF THE HIGH-PRESSURE TURBINE OF A GAS TURBINE ENGINE WITH CLEARANCE CONTROL

(75) Inventors: Jean-Baptiste Arilla, Issy les Moulineaux (FR); Alain Dominique Gendraud, Vernou la Celle/Seine (FR)

(73) Assignee: Snecma Moteurs, Paris (FR)

( * ) Notice: Subject to any disclaimer, the term of this patent is extended or adjusted under 35 U.S.C. 154(b) by 21 days.

(21) Appl. No.: 10/204,403

(22) PCT Filed: Jan. 3, 2002

(86) PCT No.: PCT/FR02/00011

§ 371 (c)(1),
(2), (4) Date: Aug. 27, 2002

(87) PCT Pub. No.: WO02/053876

PCT Pub. Date: Jul. 11, 2002

(65) Prior Publication Data

US 2003/0031557 A1 Feb. 13, 2003

(30) Foreign Application Priority Data

Jan. 4, 2001 (FR) ..... 01 00059

(51) Int. Cl.[7] ..... F01D 25/26

(52) U.S. Cl. ..... 415/138; 415/173.1

(58) Field of Search ..... 415/173.1, 173.2, 415/173.3, 115, 116, 136, 138, 175, 176, 177, 178

(56) References Cited

U.S. PATENT DOCUMENTS

| | | | | |
|---|---|---|---|---|
| 3,966,354 A | * | 6/1976 | Patterson | 415/116 |
| 5,022,816 A | | 6/1991 | Maier et al. | 415/115 |
| 5,056,988 A | | 10/1991 | Corsmeier et al. | 415/173.2 |
| 5,127,793 A | | 7/1992 | Walker et al. | 415/115 |
| 5,205,708 A | * | 4/1993 | Plemmons et al. | 415/173.1 |
| 5,964,575 A | * | 10/1999 | Marey | 415/115 |
| 6,200,091 B1 | * | 3/2001 | Bromann et al. | 415/173.1 |
| 6,435,820 B1 | * | 8/2002 | Overberg | 415/138 |

FOREIGN PATENT DOCUMENTS

| | | |
|---|---|---|
| EP | 0 516 322 | 12/1992 |
| FR | 2 743 603 | 7/1997 |
| FR | 2 780 443 | 12/1999 |
| WO | 00 57033 | 9/2000 |

* cited by examiner

*Primary Examiner*—Edward K. Look
*Assistant Examiner*—Dwayne J. White
(74) *Attorney, Agent, or Firm*—Oblon, Spivak, McClelland, Maier & Neustadt, P.C.

(57) ABSTRACT

The support spacer sector (14) minimizes functional clearances (J) between the end of the blades (3) and the ring (12) of the high-pressure turbine and the assembly clearances of the support spacer sectors (14) on the casing of the high-pressure turbine (1). Each support spacer sector (14) has a tab (20) on the upstream side one end (21) of which is supported on the inside wall (1I) of the casing of the high-pressure turbine (1) thus forming an intimate contact between the attachment parts of this support spacer sector (14) with the corresponding parts of the casing of the high-pressure turbine (1). This invention applies to turbomachines fitted on an aircraft.

3 Claims, 6 Drawing Sheets

STAY SECTOR OF STATOR SHROUD OF THE HIGH-PRESSURE TURBINE OF A GAS TURBINE ENGINE WITH CLEARANCE CONTROL

DESCRIPTION

1. Technical Field

The invention relates to turbomachines, like those used for aircraft propulsion, and particularly the ring support spacer for the high pressure turbine and its assembly with minimized clearances.

2. Prior Art and Problem that Arises

Figure 1:
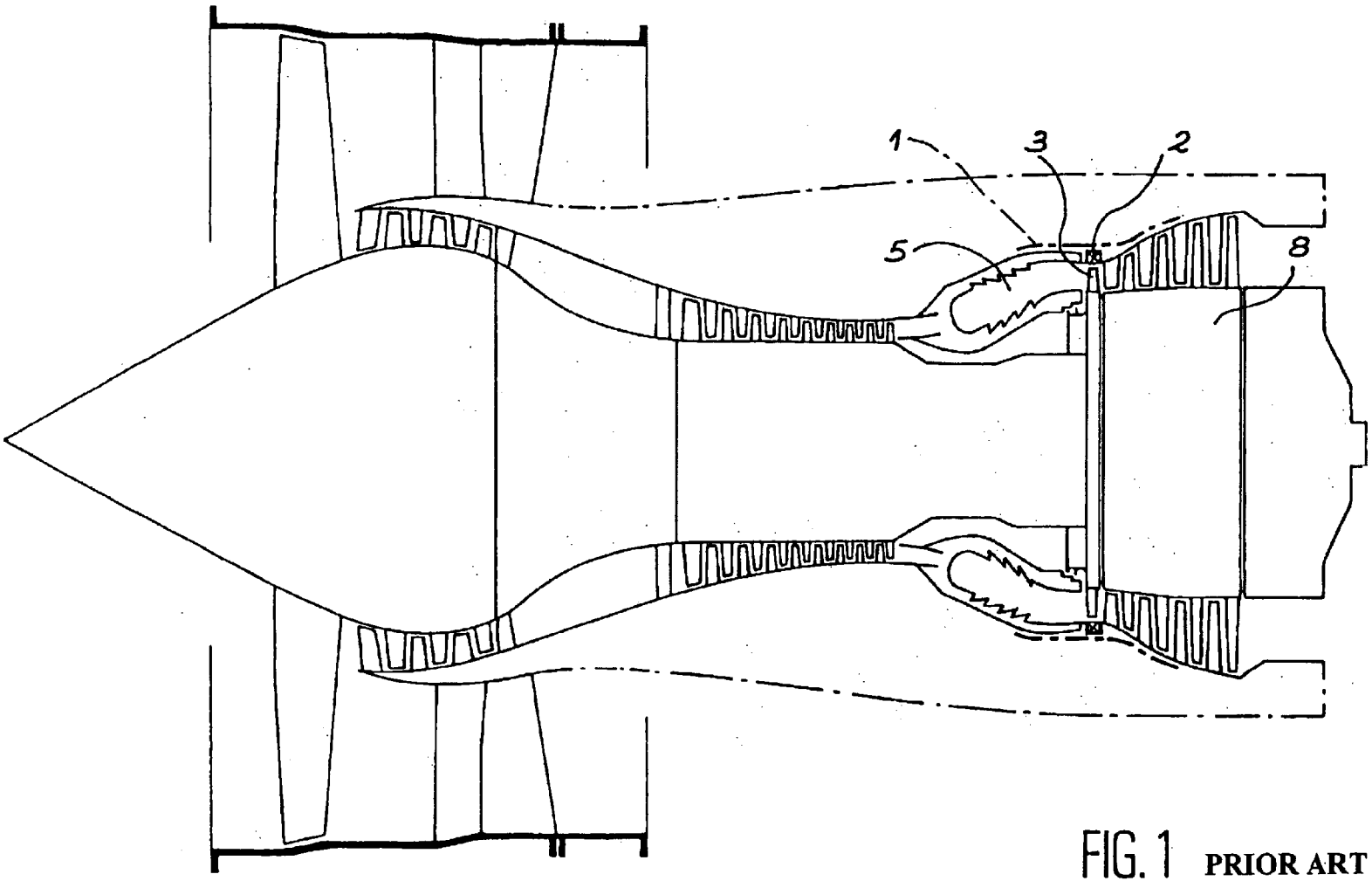
FIG. 1 PRIOR ART

With reference to FIG. 1, as described in patent document EP-0 555 082, in many different turbomachines, the turbine casing 1 of the stator comprises annular parts 2 facing the blades 3 of the rotor 8, at the inlet to the high pressure turbine on the output side of the combustion chamber 5. Therefore these annular parts 2 of the turbine casing 1 define a clearance with the end of the blades 3 of the rotor 4, and consequently control the efficiency of the turbomachine.

These annular parts 2 are supplied with gas at temperatures that can either expand them or contract them to minimize the actual clearance between these blades 3 and these annular parts 4, in order to increase the efficiency of the turbomachine. The gas is usually drawn off from another part of the turbomachine as a function of the gas temperature or the rotor speed.

Figure 2:
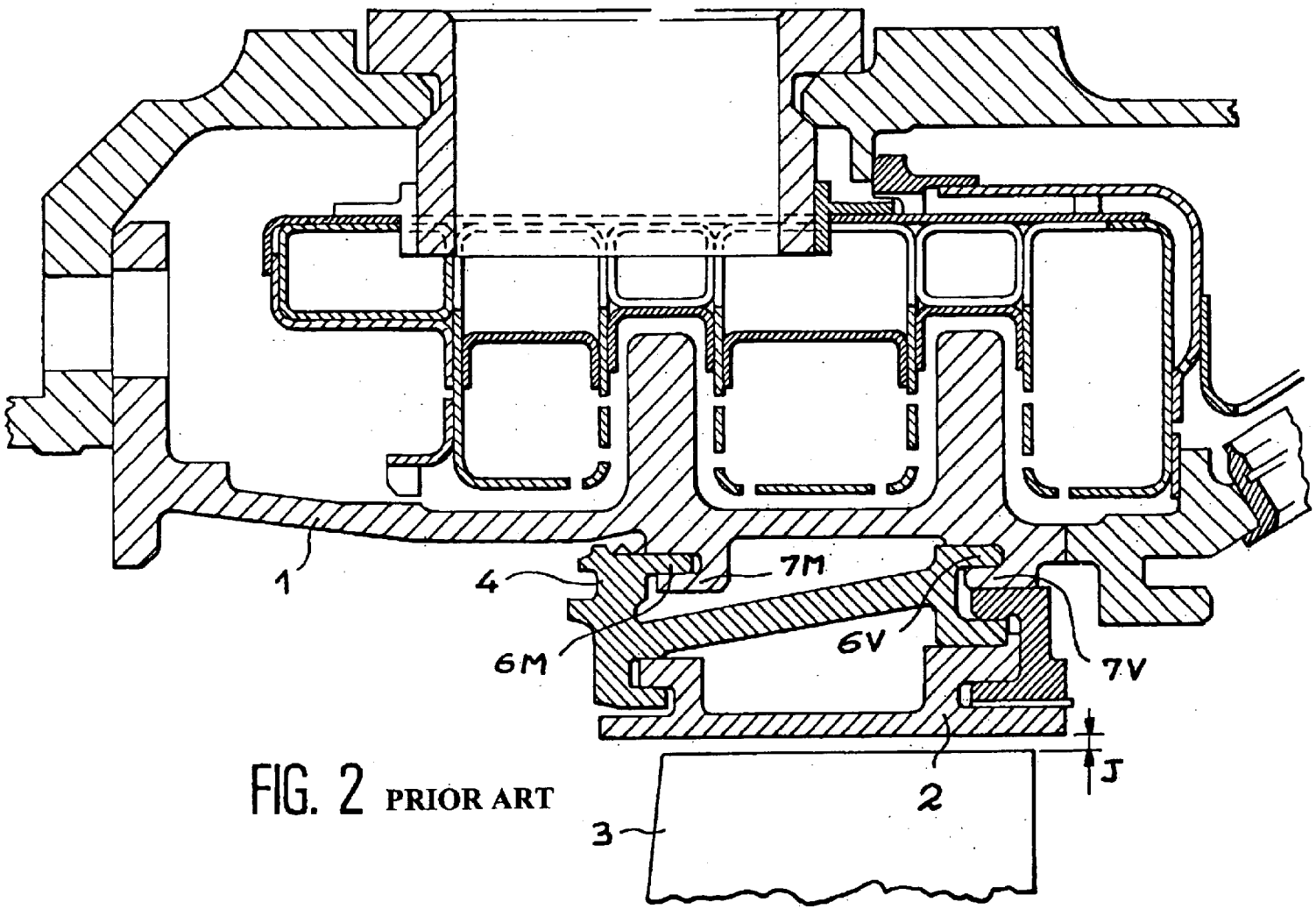
FIG. 2 PRIOR ART

FIG. 2 shows the details of an embodiment according to prior art of the attachment of a stator ring 2 around the ends of the blades 3 of the rotor 4. A ring is composed of a large number of ring sectors 2, each positioned in support spacer sectors 4 that are themselves fixed to the inside of the casing 1 of the high pressure turbine. Consequently, each support spacer sector 4 has an upstream outer foot 6M and a downstream outer foot 6V that will be inserted in a corresponding upstream hook 7M or downstream hook 7V on the high pressure turbine casing 1. It is found that a clearance J has to be allowed between the ends of the blades 3 and the wall of each ring sector 2. The temperature differences between the rest and operating positions at these elements are very large for this type of turbomachine. The result is various expansions in three dimensions at different scales on the parts forming part of this assembly. Obviously, if the clearance J remains significant, particularly during the operating phases of the turbomachine, the efficiency of the turbine will be very much reduced.

Document EP-0 555 082 also describes an assembly process by tightening the spacer or the suspension element of each ring sector in the high pressure turbine.

Figure 3:
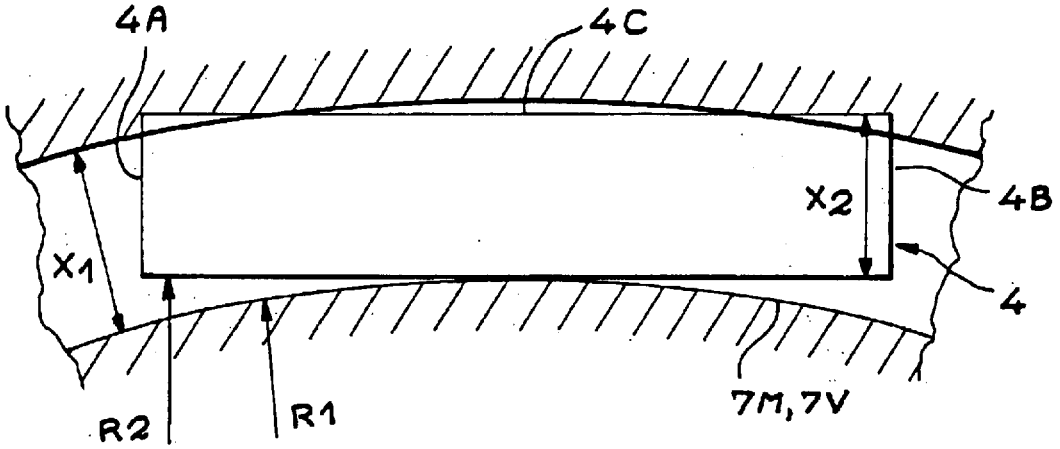
FIG. 3 PRIOR ART
Figure 4:
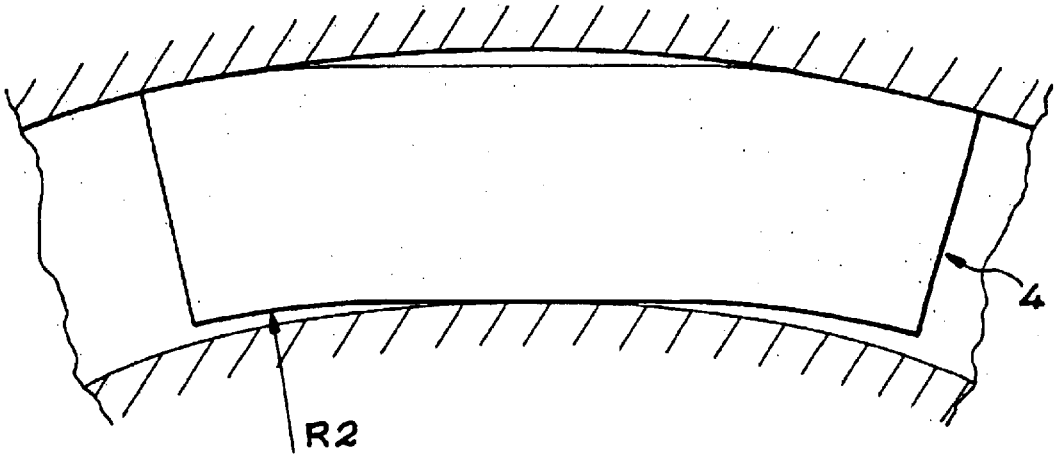
FIG. 4 PRIOR ART

FIG. 3 illustrates the placement of a support spacer 4 with two ends 4A and 4B and a median part 4C, represented superposed on a part of the high pressure turbine casing 1 and its upstream hook 7M and downstream hook 7V. The high pressure turbine casing 1 comprises a first radius R1 and a first width X1. The support spacer sector 4 comprises a second radius R2 and a second width X2. The second radius R2 is offset from the first radius R1, such that the second radius R2 is larger than the first radius R1. Furthermore, the first width X1 is preferably greater than the second width X2. The support spacer sector 4 is force fitted into the slit formed by the hooks 7M and 7V and the high pressure turbine casing 1. This force fitted assembly creates a spring effect in the support spacer sector 4 due to the deformation or deflection of the ends 4A and 4B of this support spacer sector 4 as shown in FIG. 4.

Due to the radial temperature gradients at this level, these support spacer sectors 4 are subject to deformations, particularly concerning their camber. Considering the fact that the hot fibers are located towards the inside of the compressor and the cold fibers are towards the outside of the compressor, the support spacer sectors tend to see their camber angle R2 increase, which increases bending. Furthermore, the large number of successive flight cycles undergone by this type of turbomachine means that these elements reach high temperatures very many times and therefore the geometry of these parts varies from their initial geometry. This makes it more difficult to compensate for clearances. The clearance J between the ends of the blades and the turbine ring increases, reducing the efficiency of the turbomachine.

Therefore, the purpose of the invention is to propose another solution to compensate for the clearances between the ends of the rotor blades and the ring sectors at the high pressure turbine, by attempting to prevent deformations due to radial temperature gradients.

SUMMARY OF THE INVENTION

Consequently, the main purpose of the invention is a support spacer sector for the ring of the high pressure turbine in a turbomachine with compensation for spacer sector assembly clearances and functional clearances between the ring and the end of the blades, this sector comprising:

- an upstream radial wall with an external upstream hook that will be axially engaged in an corresponding upstream notch on the high pressure casing of the turbomachine and a internal upstream hook that will be engaged in a corresponding notch in the ring;
- a downstream radial wall with an external downstream hook that will be axially engaged in an corresponding downstream hook on the high pressure casing of the turbomachine and an internal downstream hook that will fit into the corresponding ring sector;
- an upstream longitudinal tab fixed on the upstream side and the outside of the upstream radial wall with an outside thrust face at its upstream end, acting as a projection towards the outside, so that it is in contact on the inside of the casing of the high pressure turbine of the turbomachine and exerts pressure on it when the support spacer sector is in place.

According to the invention with the tab fixed on the upstream side of the upstream wall, the radial thrust surface of the end of the upstream tab is not continuous but is separated by recesses such that gases can pass through.

In the preferred embodiment of the spacer sector, a positioning notch is provided on the upstream end in which a rotation indexing pin can be fitted, penetrating into a hole in the high pressure casing of the turbomachine.

It is preferable that the outside recesses at the end of the upstream wall are not as deep as the length that projects through the indexing pin to form an angular foolproofing means when setting up the assembly.

LIST OF FIGURES

Figure 5:
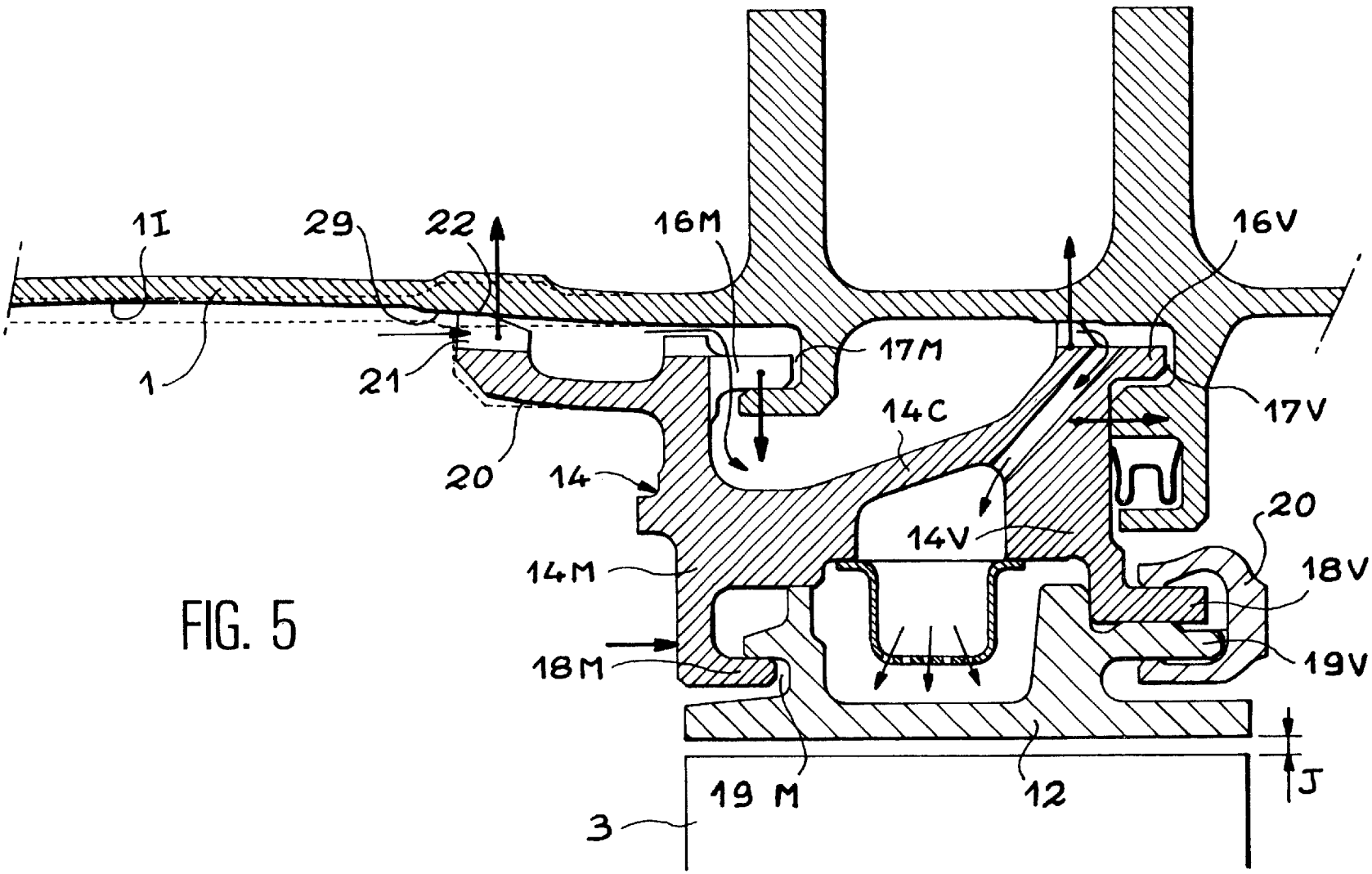
Figure 6:
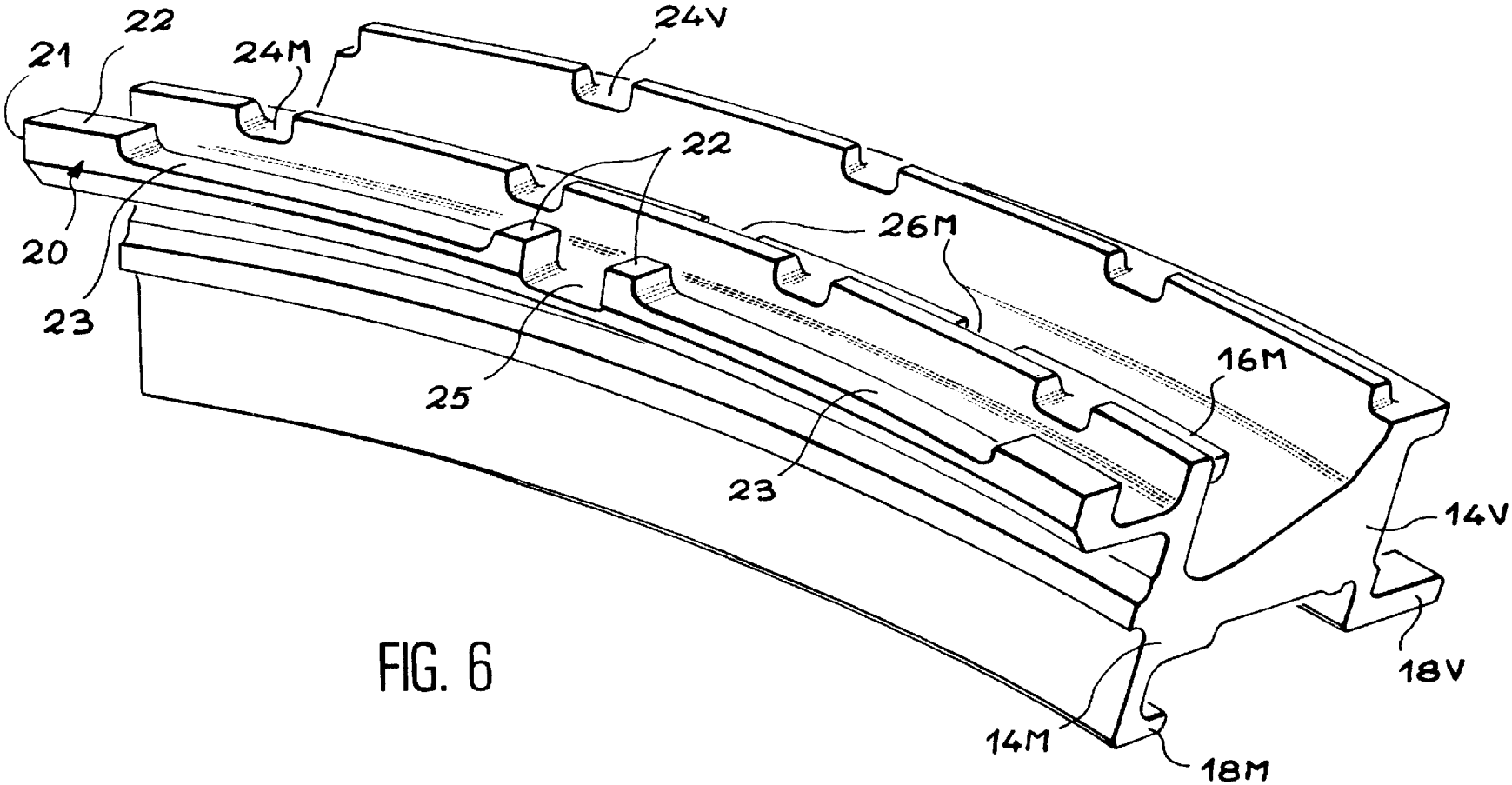
Figure 7:
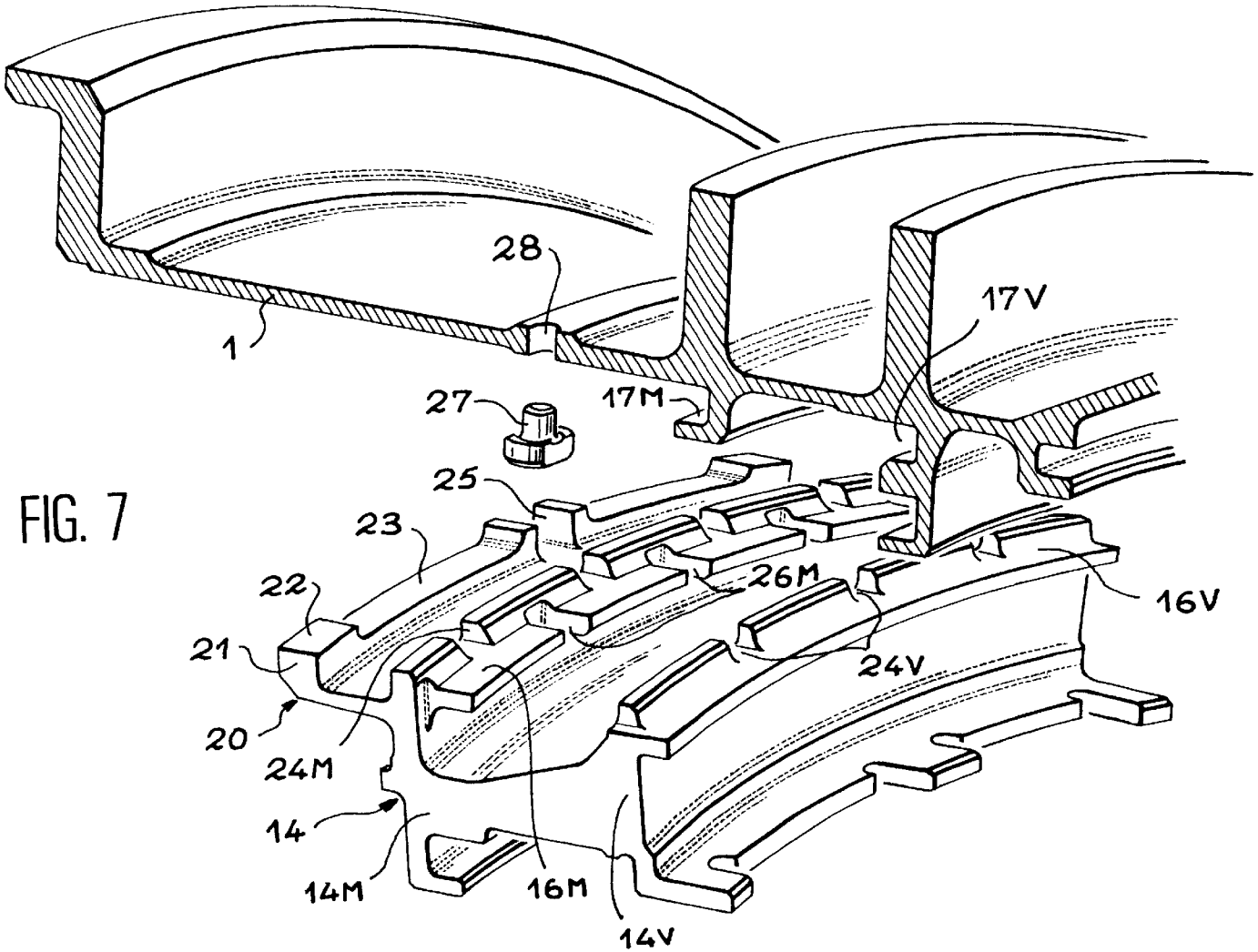

The invention and its various technical characteristics will be better understood after reading the following description illustrated by a few figures:

FIG. 1, described above, represents the position of the spacer according to the invention, in a turbomachine, FIG. 2, is a sectional view of a spacer of a turbomachine according to prior art, FIGS. 3 and 4, shows two assembly schemes for the spacer used in the turbomachine according to FIG. 2, FIG. 5, is a sectional view of the support spacer sector according to the invention, FIG. 6, shows an isometric view of the same support spacer sector according to the invention, and FIG. 7 shows an isometric perspective view of the assembly of the support spacer sector according to the invention on the casing of the high pressure turbine of the turbomachine.

DETAILED DESCRIPTION OF AN EMBODIMENT OF THE INVENTION

Therefore, FIG. 5 is a sectional view of the main embodiment of the support spacer sector 14 according to the invention fixed on the internal wall 1I of the casing 1 of the high pressure turbine. This attachment is made by an external upstream hook 16M that is inserted in an external upstream notch 17M of the casing 1 of the high pressure turbine, and by an external downstream hook 16V that fits into an external downstream notch 17V of the casing 1 of the high pressure turbine. This support spacer sector 14 is used to hold a ring sector 12 in place facing the end of the rotor blades 3. This attachment is made similarly, with the use of an upstream internal hook 18M that fits into a corresponding upstream internal notch 19M of the ring sector 12 and by the internal downstream hook 18V fitting into a clip 20 surrounding the same internal downstream hook 18V and an internal downstream hook 19V in the ring sector 12. This type of closure makes the ring sector 12 gastight.

On the upstream side, the support spacer sector 14 is fitted with a tab 20 fixed on the outside part of the upstream wall 14 and extending concentrically with the spacer formed by all the support spacer sectors 14, in other words the high pressure turbine casing 1. This tab 20 has an end 21 that extends towards the outside such that a radial thrust surface 22 comes into contact with the inside face 1I of the high pressure turbine casing 1 of the. The positions suggested by the dashed lines show the natural position of the high pressure turbine casing land the tab 20, when cold. The bold lines show the operating position, in other words the position when hot in which stresses are such that deformations have taken place.

FIG. 5 contains arrows that also show the different forces involved at this level. The different arrows, the bottom of which are located on a part, show the forces applied to these parts, particularly by gas during normal operation of the turbomachine. Furthermore, it shows that the bending that is generated does not take place in a radial plane, in other words perpendicular to the center line of the engine, but in a longitudinal plane. During operation, this longitudinal bending is relieved since the thrust faces are functional surfaces. Furthermore, the high pressure turbine casing 1 expands more than the control rings of the casing 5 which are cooled by the impact housings. Therefore, this differential expansion relieves the tab 20 in bending.

A small portion of the inclined surface 29 can be seen on the inside wall 1I of the casing, located just on the upstream side of the end 21 of the tab 20. Thus, on the upstream side, the casing 1 is thinner. This means that the external hooks 16M and 16V of each support spacer sector 14 can be inserted before the radial thrust surface 22 of the tab 20 comes into contact with the inside face 1I of the casing 1. This facilitates the assembly of each support spacer sector 14. Each support spacer sector 14 may be positioned or offset by a given angle before coming into close contact through the different parts of the casing 1.

On this FIG. 5, the arrows pass through orifices in the system or spaces between several parts. They symbolize gas passages in the assembly formed at the support spacer sectors 14. In this respect, note that the end 21 of the tab 20, the outside end of the upstream wall 14M and the upstream hook 16M are provided with recesses to allow the passage of these gases. These recesses can be seen more clearly in FIGS. 6 and 7.

With reference to FIG. 6, it can be seen that the end 21 of the tab 20 is fitted firstly with a series of radial thrust surfaces 22, that these are separated by recesses 23 to enable the passage of gases and at least one positioning notch 25, which is deeper than the recesses 23 and the function of which is described later. These recesses 23 are used to limit the intensity of forces passing through the assembly. These radial thrust surfaces 22 are placed at the end 21 of the tab 22 to distribute forces in the parts and to give a better position support of the functional surfaces of the assembly. It would be possible to place these radial thrust surfaces 22 closer to the body of the support spacer sectors 14. Similarly, the outside part of the upstream wall 14M is also fitted with recesses 24M to enable gases to pass, and the external part of the downstream wall 14V that is also provided with recesses 24V similar to the recesses 24M in the upstream wall. This FIG. 6 also shows recesses 26M formed rather less distinctly on the external upstream hook 16M, also still for the passage of gases as shown in FIG. 5.

The function of the positioning notch 25 is now explained with reference to FIG. 7. This figure shows a anti-rotation pin 27 installed tight fitting in a hole 28 in the casing 1. Its role is to contribute to the angular position of a support spacer sector 14 by preventing it from being inserted in the notches 17M and 17V of casing 1 unless the positioning notch 25 is facing the anti-rotation pin 27. The length of the projecting part of this anti-rotation pin 27 is greater than the depth of the recesses 23 between the radial thrust surfaces 22 of the end 21 of the tab 20. Consequently, a single position enables assembly of the spacer sectors 14 in their position. The centering pin 27 is shouldered to prevent it from escaping towards the outside of the assembly.

This same FIG. 7 clearly shows the recesses 26M formed in the external upstream hooks 16M. This also shows the downstream recesses 24V formed in the external part of the downstream wall 24V, in the same way as for the external upstream recesses 24V formed in the external part of the upstream wall 14M.

Note that for assembly, there is no need to camber or to prepare each support spacer sector 14 before inserting it in the attachment elements of the high pressure turbine casing 1. Furthermore, the angular position can be determined without tightening each support spacer sector 14.

Note that the surfaces of each support spacer sector 14 that are in contact are functional surfaces, namely the radial thrust surfaces 22 of the tab 20, and the inside surfaces of the external hooks 16M and 16V. Considering the fact that the part of the casing 1 of the high pressure turbine facing the tab 20 expands more than the tab 20 during operation, the pressure on the end 21 on the tab 20 exerted by the wall of the casing 1 of the high pressure turbine, is reduced and the pressure on the tab 20 is slightly relieved. However, forces due to the engine driving gasses contribute to positioning the set of support spacer sectors 14.

It can be understood that the tab 20 on each support spacer sector 14 pressing in contact with the internal wall 1I of the high pressure turbine casing 1, contributes to positioning the other functional surfaces of each support spacer sector 14 in contact with the attachment elements of the high pressure turbine casing 1. In other words, there is intimate contact, particularly at the external upstream hooks 16M and 16V with the elements facing them. Furthermore, the tab 20 tends to position each support spacer sector 14 to be as far as possible from the high pressure turbine casing 1, thus reducing the clearance J remaining between the end of each blade 3 and the ring sectors 12 fixed to the support spacer sectors 14.

What is claimed is:

1. Support spacer sector (14) for the stator ring (12) of a high pressure turbine in a turbomachine with compensation for the clearances of the spacer sector assembly (14) and functional clearances (J) between the ring sectors (12) and the ends of the blades (3) of the rotor, this sector comprising:

an upstream radial wall (14M) with an external upstream hook (16M) that will be axially engaged in an corresponding upstream notch (17M) on the high pressure casing (1) of the turbomachine;

an internal upstream hook (18M) that will be engaged in a corresponding upstream notch (19M) in a ring sector (12);

a downstream radial wall (14V) with an external downstream hook (16V) that will be axially engaged in a corresponding downstream notch (17V) on the high pressure casing (1) of the turbomachine;

an internal downstream hook (18V) that will be fixed to the corresponding ring sector (12), and a longitudinal tab (20) fixed on the outside of the wall, with an outside thrust surface (22) at its upstream end (21) that projects towards the outside, so that it is in contact on the inside (1I) of the turbomachine high pressure turbine casing (1) and exerts pressure on it when the support spacer sector (14) is in place, characterized in that the tab (20) is fixed on the upstream side of the upstream wall (14M), the radial thrust surface (22) of the end (21) of the upstream tab (20) is not continuous but is separated by recesses (23) such that gases can pass through.

2. Support spacer sector (14) according to claim 1, characterized by the fact that it comprises a positioning notch (25) on the upstream end of the upstream wall (14M) in which a rotation indexing pin (27) can be fitted, penetrating into a hole (28) in the high pressure turbine casing (1).

3. Support spacer sector according to claim 2, characterized in that the external recesses (23) at the outside end of the upstream wall (14M) are not as deep as the projecting length of the indexing pin (27) to form an angular foolproofing means during assembly.

* * * * *